US008354805B2

(12) United States Patent
Jacobs et al.

(10) Patent No.: US 8,354,805 B2
(45) Date of Patent: Jan. 15, 2013

(54) DEVICE FOR DRIVING A LOAD

(75) Inventors: Joseph Hendrik Anna Maria Jacobs, Eygelshoven (NL); Jie Shen, Aachen (DE); Dirk Hente, Wuerselen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 317 days.

(21) Appl. No.: 12/740,125

(22) PCT Filed: Nov. 3, 2008

(86) PCT No.: PCT/IB2008/054555

§ 371 (c)(1), (2), (4) Date: Apr. 28, 2010

(87) PCT Pub. No.: WO2009/060368

PCT Pub. Date: May 14, 2009

(65) Prior Publication Data

US 2010/0259194 A1 Oct. 14, 2010

(30) Foreign Application Priority Data

Nov. 5, 2007 (EP) ..... 07119959

(51) Int. Cl.
*H05B 37/02* (2006.01)

(52) U.S. Cl. ..... 315/360; 315/291; 315/307

(58) Field of Classification Search ..... 315/291, 315/307, 308, 360
See application file for complete search history.

(56) References Cited

U.S. PATENT DOCUMENTS

| | | | | |
|---|---|---|---|---|
| 6,747,420 | B2 * | 6/2004 | Barth et al. | 315/291 |
| 6,917,185 | B2 * | 7/2005 | Okamoto | 323/241 |
| 7,276,861 | B1 | 10/2007 | Shteynberg et al. | |
| 7,323,851 | B2 * | 1/2008 | Markowski | 323/222 |
| 7,573,210 | B2 * | 8/2009 | Ashdown et al. | 315/307 |
| 2003/0085749 | A1 | 5/2003 | Xu et al. | |
| 2005/0128773 | A1 * | 6/2005 | Yang et al. | 363/21.01 |
| 2005/0146908 | A1 * | 7/2005 | Feldtkeller | 363/125 |
| 2007/0152604 | A1 | 7/2007 | Tatsumi | |
| 2008/0042628 | A1 | 2/2008 | Wang | |
| 2008/0259649 | A1 * | 10/2008 | Marchand et al. | 363/21.03 |

FOREIGN PATENT DOCUMENTS

| | | |
|---|---|---|
| CN | 1909759 | 2/2007 |
| EP | 1689213 A1 | 8/2006 |

* cited by examiner

*Primary Examiner* — Thuy Vinh Tran
(74) *Attorney, Agent, or Firm* — Kenneth D. Springer; Mark L. Beloborodov

(57) ABSTRACT

Devices (10) for driving loads (20) such as organic/inorganic light emitting diodes are provided with drivers (11) for driving the loads (20), with converters (12) for converting first parameter signals defining parameters of the loads (20) into second parameter signals each being defined by one bit per time interval, and with digital controllers (13) for controlling the drivers (11) in response to the second parameter signals. The converter (12) may comprise a comparator circuit (40) and a timer circuit (41) for comparing the first parameter signal with a reference signal and for generating the second parameter signal having a respective first or second value of two possible values in case of a respective first or second comparison result. The parameter may be a current flowing through or light emitted by at least a part of the load (20). The driver (11) may be a buck/boost/buck boost/fly back converter.

14 Claims, 9 Drawing Sheets

DEVICE FOR DRIVING A LOAD

FIELD OF THE INVENTION

The invention relates to a device for driving a load, and also relates to a method for driving a load. Examples of such a device are power supply circuits and consumer products and non-consumer products, or parts thereof. Examples of such a load are inorganic and organic light emitting diodes.

BACKGROUND OF THE INVENTION

U.S. Pat. No. 6,747,420 B2 discloses in its title a drive circuit for light emitting diodes and discloses in its Figures a driver (circuit 4), a load (LED 1), a digital controller (μC 3) and a converter (R-shunt 6) for converting an analog current signal defining a current flowing through the load into an analog voltage signal. This analog voltage signal is supplied to the driver. The digital controller controls the driver and controls the converter, and the converter instructs the driver. This is a relatively complex and relatively inefficient construction.

SUMMARY OF THE INVENTION

Objects of the invention are to provide a relatively simple and relatively efficient device and to provide a relatively simple and relatively efficient method.

A device for driving a load is defined by comprising a driver for driving the load, a converter for converting a first parameter signal defining a parameter of the load into a second parameter signal, the second parameter signal having, during each time interval of a group of time intervals, one out of two possible values, and a digital controller for controlling the driver in response to the second parameter signal.

The converter converts a first parameter signal such as an analog parameter signal defining a parameter of the load into a second parameter signal such as a digital parameter signal. The second parameter signal has, during each time interval of a group of time intervals, one out of two possible values, and is therefore a so-called one bit signal. Per time interval, the second parameter signal comprises and/or is defined by one bit, and per group of (serial) time intervals, the second parameter signal comprises and/or is defined by a group of (serial) bits. The one bit signal is supplied to the digital controller, and the digital controller controls the driver in response to at least the one bit signal. As a result, a relatively simple and relatively efficient construction has been created.

The device is further advantageous in that a feedback loop between the converter and the digital controller is avoided, and in that a relatively sensitive and relatively complex analog hysteretic control has been converted into a relatively non-sensitive and relatively simple digital hysteretic control. Another advantage is that relatively slow and relatively expensive analog-to-digital converters and digital-to-analog converters are avoided. The device according to the invention is extremely stable, fast, cost effective and reliable.

In case of an analog-to-digital converter already being present for another reason, the first parameter signal may alternatively be a digital parameter signal comprising two or more bits and originating from the analog-to-digital converter.

Compared to a prior art average current control, the one bit digital control is more cost effective, more stable, more efficient and has a better dynamic response.

Compared to a prior art peak current control, the one bit digital control is more cost effective, more stable, more efficient and has a better dynamic response.

Compared to a prior art analog hysteretic control, the one bit digital control is more cost effective and more efficient and has a good stability and a good dynamic response.

The precision of the one bit digital control in certain points of operation may result in small errors that can be predetermined and that can be minimized through design.

According to an embodiment, the device is defined by the converter comprising a circuit for comparing the first parameter signal with a reference signal and for generating, during each time interval of a group of time intervals, the second parameter signal having a respective first or second value of the two possible values in case of a respective first or second comparison result. The time interval may be introduced before or after the comparison. Preferably, the device is defined by the circuit comprising a comparator circuit and a timer circuit. A comparator circuit such as an analog comparator and a timer circuit such as a flip flop are simple and low cost circuits. But other kinds of circuit are not to be excluded.

According to an embodiment, the device is defined by the second parameter signal having a frequency equal to or smaller than a predefined maximum frequency. The maximum switching frequency of the driver is set by the design of the system (controller and driver). The maximum frequency of the second parameter signal is also set. Sub-harmonics will further depend on the design and the load. As a result, sub-harmonics become predictable for a given reference signal. Such sub-harmonics may be difficult to avoid, but a proper design will reduce and/or minimize such sub-harmonics and/or will shift them to unimportant frequencies and/or will work around them.

According to an embodiment, the device is defined by the load comprising one or more inorganic and/or organic light emitting diodes, and the parameter being a current flowing through at least a part of the load and/or light emitted by at least a part of the load. Preferably, the device is defined by the digital controller being arranged to further control the driver in response to one or more user signals and/or one or more further parameter signals defining one or more further parameters of the load.

The further parameters may be other parameters, such as a temperature of the load or of one or more parts thereof, another light aspect such as an intensity and a spectrum etc. The digital controller may compensate for a temperature impact, aging and a color point etc. The user signals may set a preferred light scene, a color and an intensity etc.

According to an embodiment, the device is defined by the digital controller being one micro processor and/or one digital signal processor and/or one integrated circuit and/or one field programmable gate array and/or one complex programmable logic device and/or one personal computer and/or one programmable logic array, at least a part of the converter being an external circuit coupled to the digital controller or being an internal circuit forming part of the digital controller.

This is an extremely advantageous embodiment owing to the fact that two prior art controllers, one for solely controlling the driver and one for solely processing the parameter signals and the user signals, are combined into one digital controller.

According to an embodiment, the device is defined by the driver comprising a switch that is activated in response to the second parameter signal having a first value of the two possible values and that is deactivated in response to the second parameter signal having a second value of the two possible values. Preferably, the device is defined by the driver being a buck converter or a boost converter or a buck boost converter or a fly back converter. But other kinds of drivers are not to be excluded.

The device may further comprise the load. The device may further be coupled to and/or comprise an ac/dc converter and/or a dc/dc converter and/or another kind of supplying circuit.

A method for driving a load is defined by comprising the steps of driving the load, converting a first parameter signal defining a parameter of the load into a second parameter signal, the second parameter signal having, during each time interval of a group of time intervals, one out of two possible values, and digitally controlling the driving in response to the second parameter signal.

Embodiments of the method correspond with the embodiments of the device.

An insight might be that analog-to-digital converters create two-or-more-bit signals, where for this invention only a one bit signal will be sufficient for informing the digital controller and for controlling the driver correspondingly.

A basic idea might be that a converter is to be introduced for converting a first parameter signal defining a parameter of the load into a second parameter signal, which second parameter signal has, during each time interval of a group of time intervals, one out of two possible values.

The invention solves a problem to provide a relatively simple and relatively efficient device and a problem to provide a relatively simple and relatively efficient method.

These and other aspects of the invention are apparent from and will be elucidated with reference to the embodiments described hereinafter.

DETAILED DESCRIPTION OF EMBODIMENTS

Figure 1:
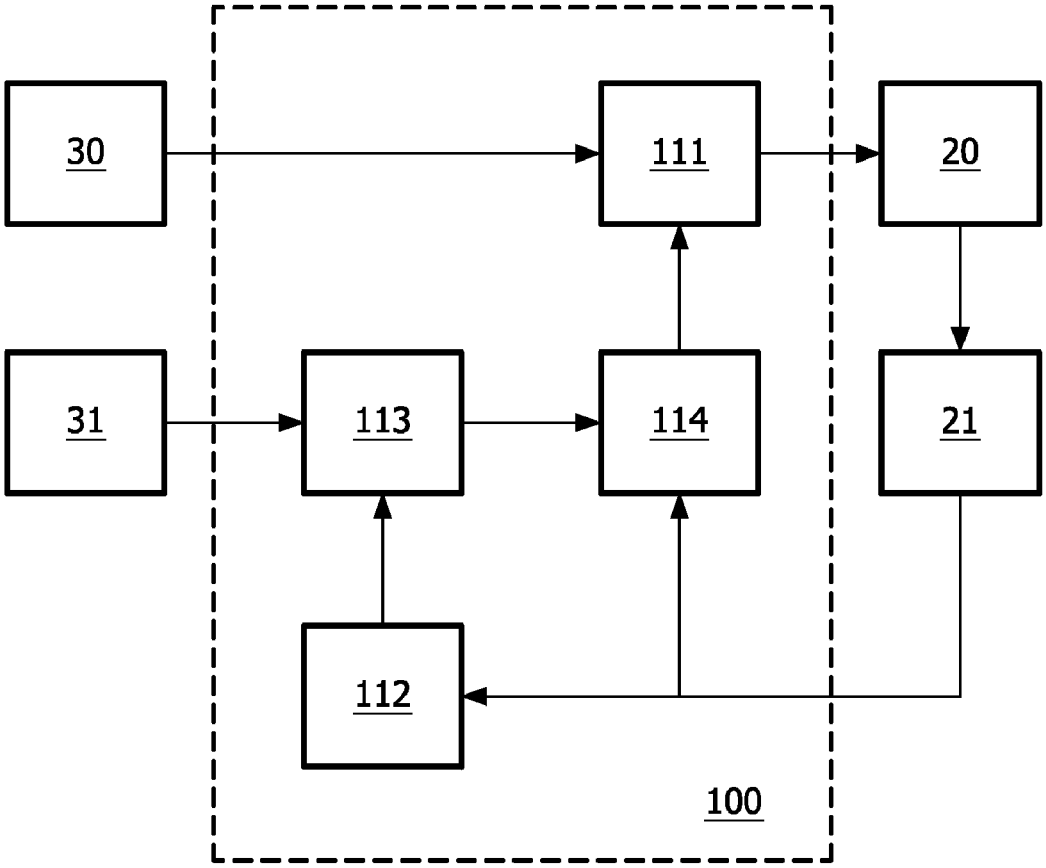
FIG. 1 (prior art)
FIG. 1 shows diagrammatically a first prior art device.

In the FIG. 1, a first prior art device 100 is shown. This prior art device 100 comprises a driver 111 coupled to a supplying circuit 30 and to a load 20. The supplying circuit 30 may perform a power factor correction, other kinds of supplies are not to be excluded. The load 20 may comprise one or more inorganic and/or organic light emitting diodes in an at least partly parallel and/or at least partly serial construction, other kinds of loads are not to be excluded. The driver 111 is further coupled to a driver controller 114, which is coupled to a sensor 21 for receiving a parameter signal from the load 20 and to a general controller 113 for controlling the driver controller 114. The general controller 113 is further coupled to an analog-to-digital converter 112 for supplying the parameter signal from the sensor 21 to the general controller 113 in a digitized form. The general controller 113 is further coupled to a user interface 31 for receiving a user signal. In this prior art situation, the controllers 113 and 114 are two separate integrated circuits.

Figure 2:
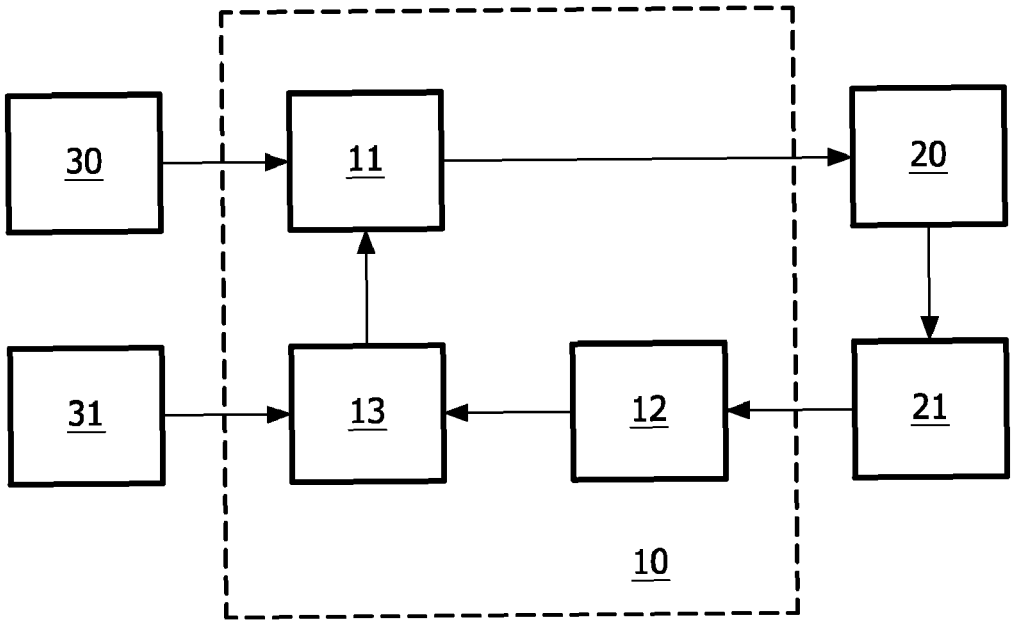
FIG. 2 shows diagrammatically a first embodiment of a device according to the invention.

In the FIG. 2, a first embodiment of a device 10 according to the invention is shown. This device 10 comprises a driver 11 coupled to a supplying circuit 30 and to a load 20. The driver 11 is further coupled to a digital controller 13 for controlling the driver 11 in response to a digital parameter signal. The digital controller 13 is coupled to a user interface 31 for receiving a user signal and to a converter 12 for converting an analog parameter signal originating from a sensor 21 coupled to the load 20 and defining a parameter of the load 20 into the digital parameter signal. This digital parameter signal has, during each time interval of a group of two or more time intervals, one out of two possible values. Alternatively, the user interface 31 may be left out, and the sensor 21 may be left out, in which case the analog parameter signal is to be derived from the load 20 or from a point near the load 20. Optionally, the digital controller 13 may be arranged to further control the driver 11 in response to more user signals and/or one or more further parameter signals defining one or more further parameters of the load 20. Preferably, the digital controller 13 is one micro processor and/or one digital signal processor and/or one integrated circuit and/or one field programmable gate array and/or one complex programmable logic device and/or one personal computer and/or one programmable logic array. At least a part of the converter may be an external circuit coupled to the digital controller 13 or may be an internal circuit forming part of the digital controller 13. The converter 12 may comprise a comparator circuit and/or a timer circuit.

Figure 3:
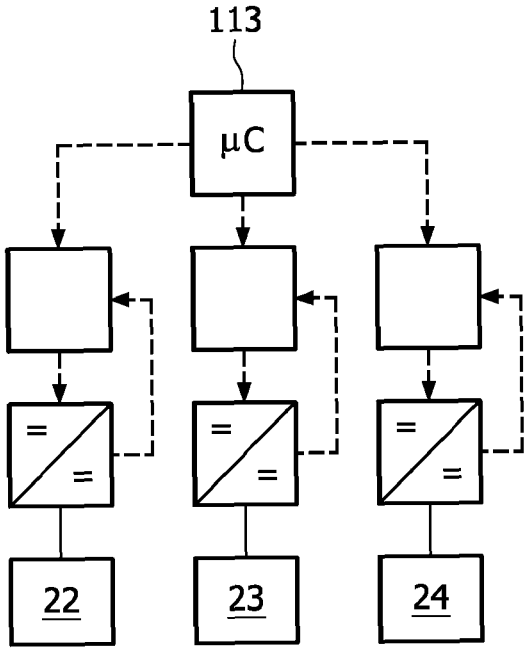
FIG. 3 (prior art)
FIG. 3 shows diagrammatically a second prior art device.

In the FIG. 3, a second prior art device is shown. This prior art device comprises a general controller 113 coupled via respective serial circuits of a driver controller and a dc/dc driver to respective loads 22-24 such as red, green and blue light emitting diodes.

Figure 4:
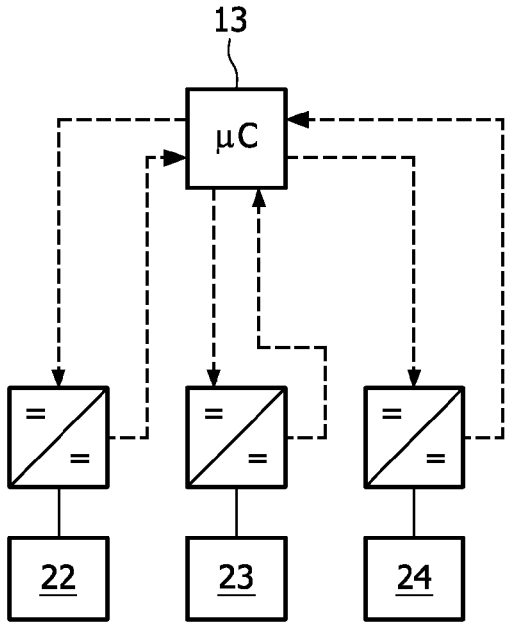
FIG. 4 shows diagrammatically a second embodiment of a device according to the invention.

In the FIG. 4, a second embodiment of a device according to the invention is shown. This device comprises a digital controller 13 coupled via respective dc/dc drivers to respective loads 22-24 such as red, green and blue light emitting diodes. In this case, the analog parameter signals are either converted inside the dc/dc drivers or inside the digital controller 13 into the digital parameter signals each having, during each time interval of a group of two or more time intervals, one out of two possible values.

Figure 5:
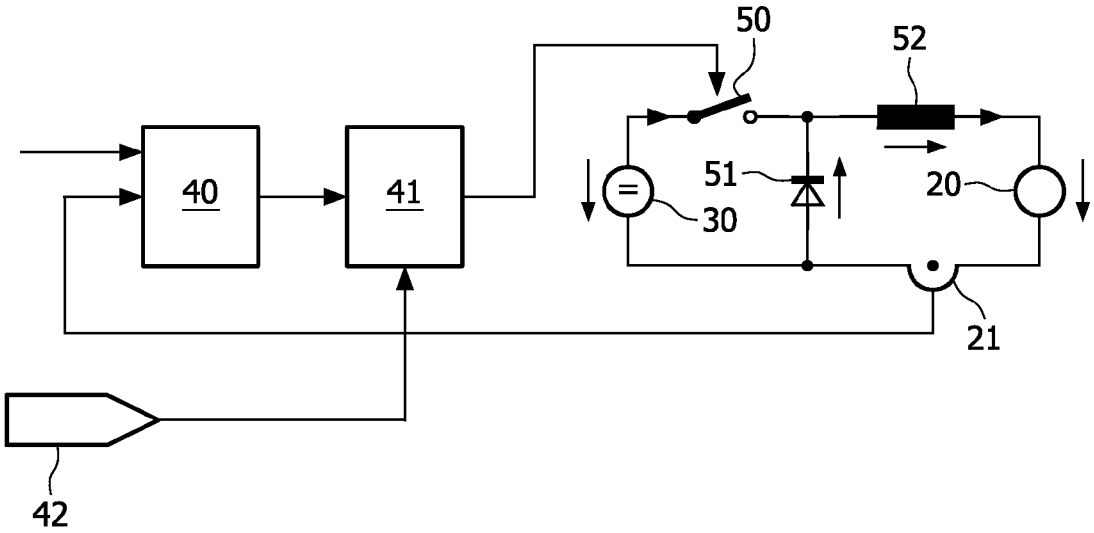
FIG. 5 shows diagrammatically a third embodiment of a device according to the invention.

In the FIG. 5, a third embodiment of a device according to the invention is shown. This device comprises a circuit 40-41 for comparing the analog parameter signal with a reference signal and for generating, during each time interval of a group of two or more time intervals, the digital parameter signal having a respective first or second value of the two possible values in case of a respective first or second comparison result. Thereto, the circuit 40-41 comprises a comparator circuit 40 and a timer circuit 41 such as a flip flop. The flip flop is coupled to a clock signal generator 42 for sampling the comparison result from the comparator circuit 40. Other kinds of circuits 40-41 are not to be excluded. The circuit

40-41 controls a switch 50, possibly via further circuitry not shown. This switch 50 such as a transistor opens or closes a serial circuit of a supplying circuit 30 and a diode 51. In parallel to the diode 51, a serial circuit of an inductor 52 and a load 20 and a sensor 21 is present. The switch 50 is activated in response to the digital parameter signal having a first value of the two possible values and is deactivated in response to the digital parameter signal having a second value of the two possible values.

Figure 6:
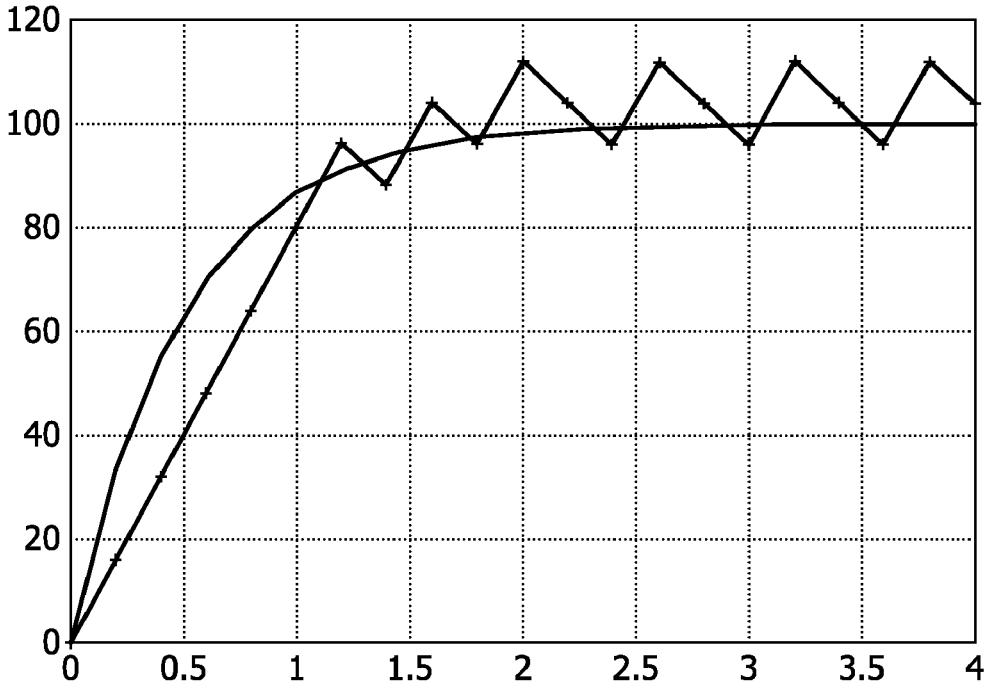
FIG. 6 shows a control process according to the invention.

In the FIG. 6, a control process according to the invention is shown, for the device shown in the FIG. 5. For an increasing reference signal having a decreasing slope, a digital parameter signal is shown in the form of a one bit digital value of a current through the load. This digital parameter signal has a frequency equal to or smaller than a predefined maximum frequency.

Figure 7:
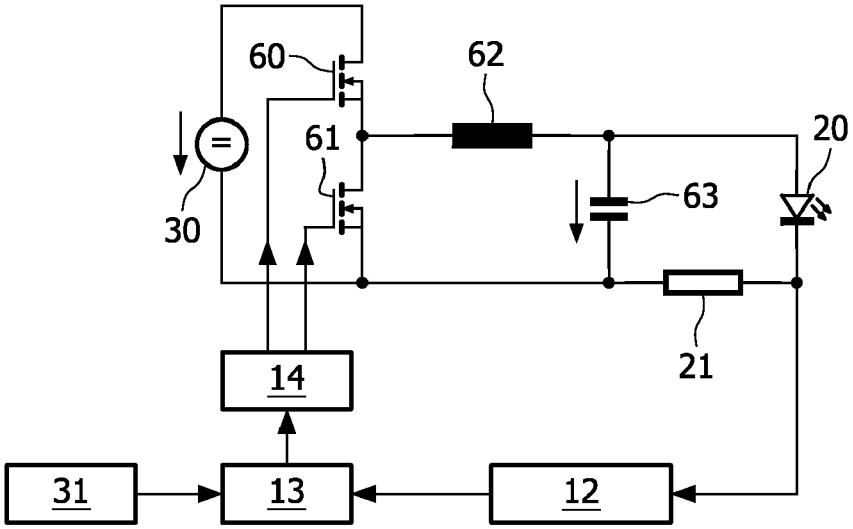
FIG. 7 shows diagrammatically a fourth embodiment of a device according to the invention.

In the FIG. 7, a fourth embodiment of a device according to the invention is shown. This device comprises a digital controller 13 coupled to a user interface 31 and to a converter 12 and, via further circuitry 14, to control electrodes of transistors 60 and 61. These transistors 60-61 form part of a buck converter and their main electrodes form a serial circuit with a supplying circuit 30. The main electrodes of the transistor 61 are further coupled in parallel to a serial circuit of an inductor 62 and a capacitor 63. The capacitor 63 is coupled in parallel to a serial circuit of a load 20 and a sensor 21 in the form of a resistor. A connection between the load 20 and the sensor 21 is coupled to the converter 12. The other side of the sensor 21 may for example be coupled to a reference potential such as ground. Alternatively, the control strategy can be applied to other converter topologies, such as a boost converter (including one with a power factor correction stage), a buck boost converter, a fly back converter, a cuk converter and a sepic converter. For these topologies, the current through the inductor is controlled. For control of the current through the load 20, the output voltage or duty cycle (ratio of switch on and off) may need to be known.

So, the converter 12 converts a first parameter signal such as an analog parameter signal defining a parameter of the load 20 into a second parameter signal such as a digital parameter signal. Alternatively, the first parameter signal may be a digital parameter signal comprising two or more bits and originating from for example an analog-to-digital converter that is already present for another kind of reason.

Figure 8:
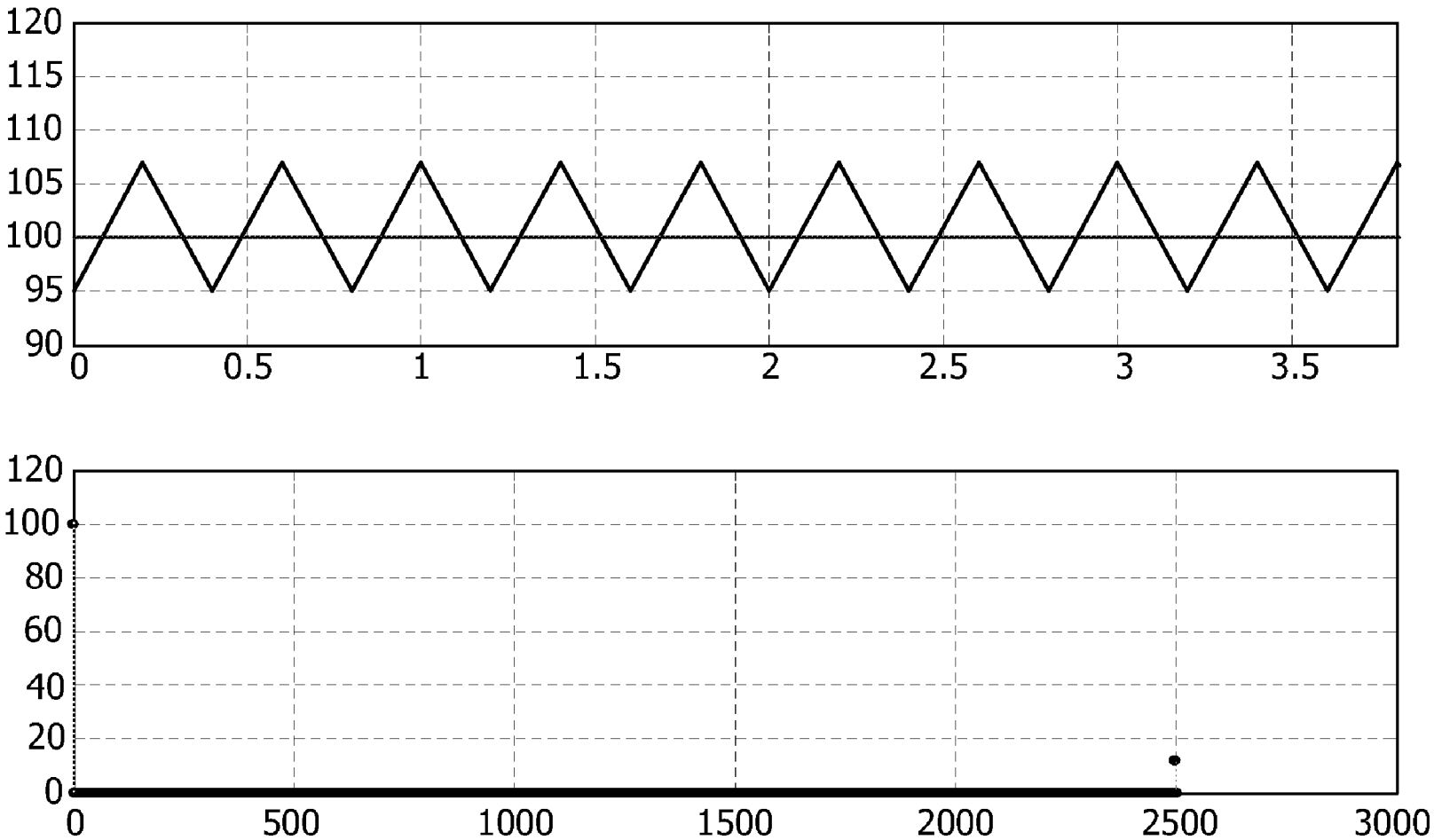
FIG. 8 shows a first simulation according to the invention.

In the FIG. 8, a first simulation according to the invention is shown, whereby Uin=24V, I=100 mA, L=200 μH, f-clock=5 MHz, Uout=12V, a=Uout/Uin=0.5, f-switch=2.5 MHz (upper graph: reference signal and one bit digital parameter signal, lower graph: frequency spectrum of the one bit digital parameter signal).

Figure 9:
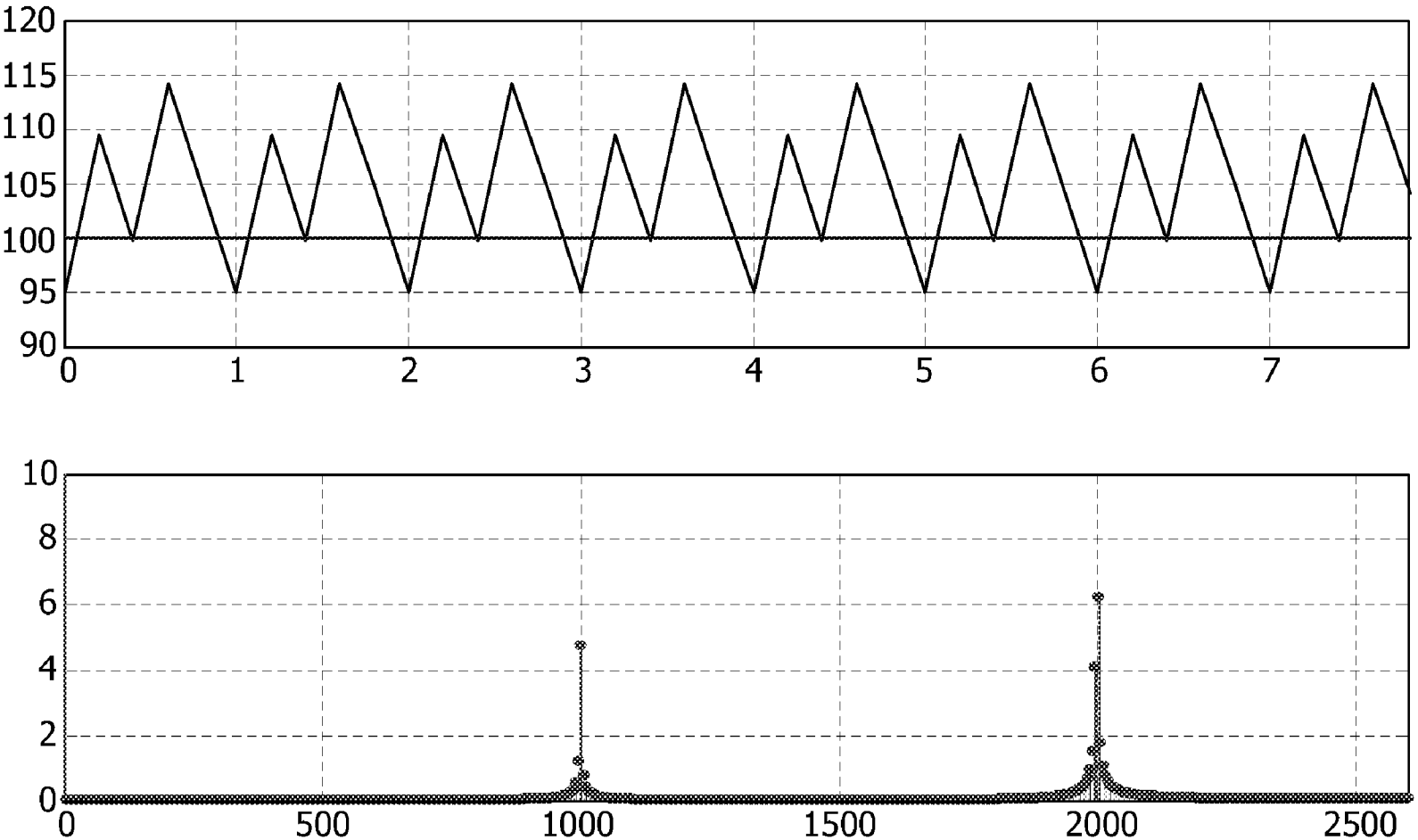
FIG. 9 shows a second simulation according to the invention.

In the FIG. 9, a second simulation according to the invention is shown, whereby Uin=24V, I=100 mA, L=200 μH, f-clock=5 MHz, Uout=9.6V, a=Uout/Uin=0.4, (upper graph: reference signal and one bit digital parameter signal, lower graph: frequency spectrum of the one bit digital parameter signal).

Figure 10:
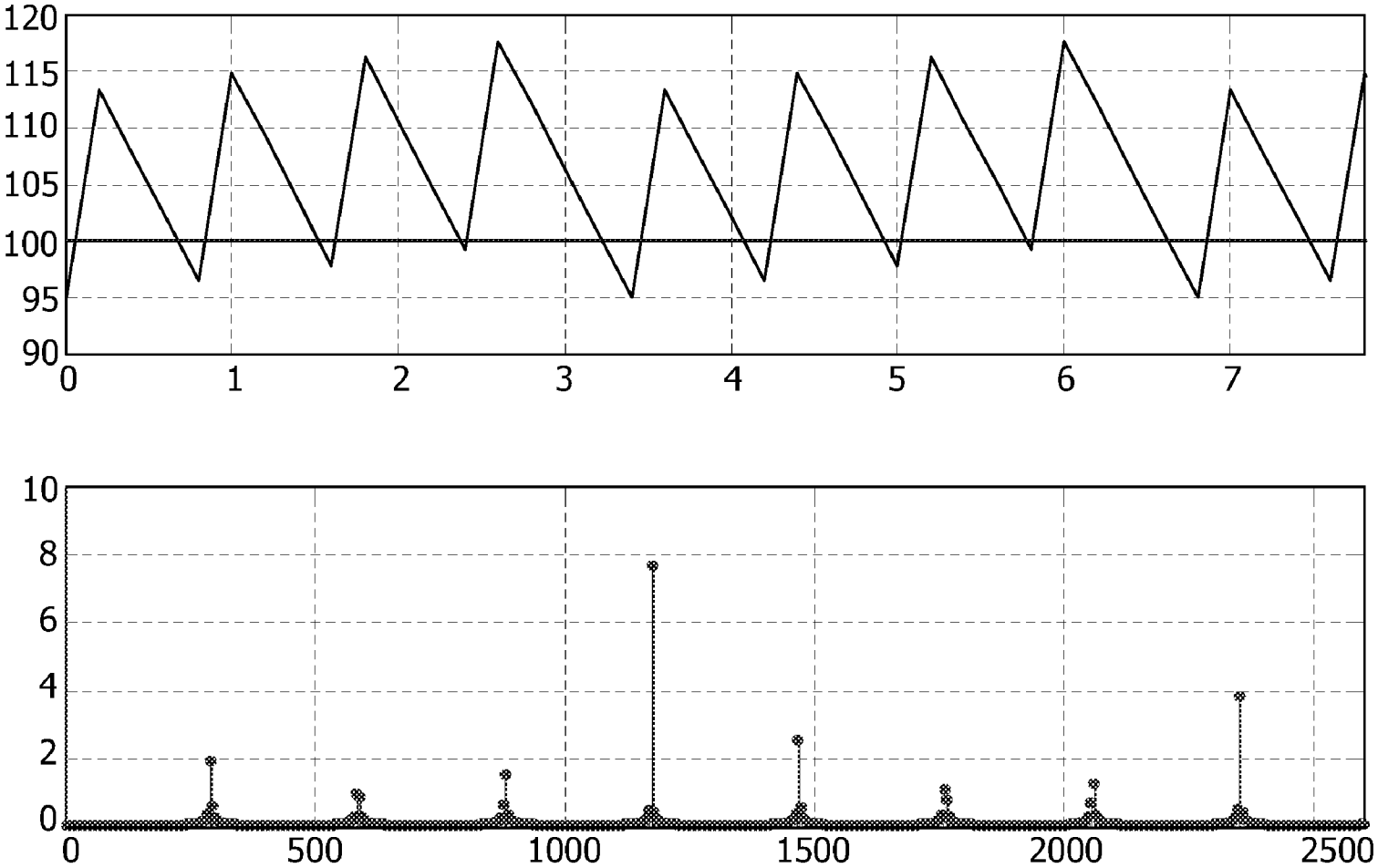
FIG. 10 shows a third simulation according to the invention.

In the FIG. 10, a third simulation according to the invention is shown, whereby Uin=24V, I=100 mA, L=200 μH, f-clock=5 MHz, a=Uout/Uin=4/17, (upper graph: reference signal and one bit digital parameter signal, lower graph: frequency spectrum of the one bit digital parameter signal).

Figure 11:
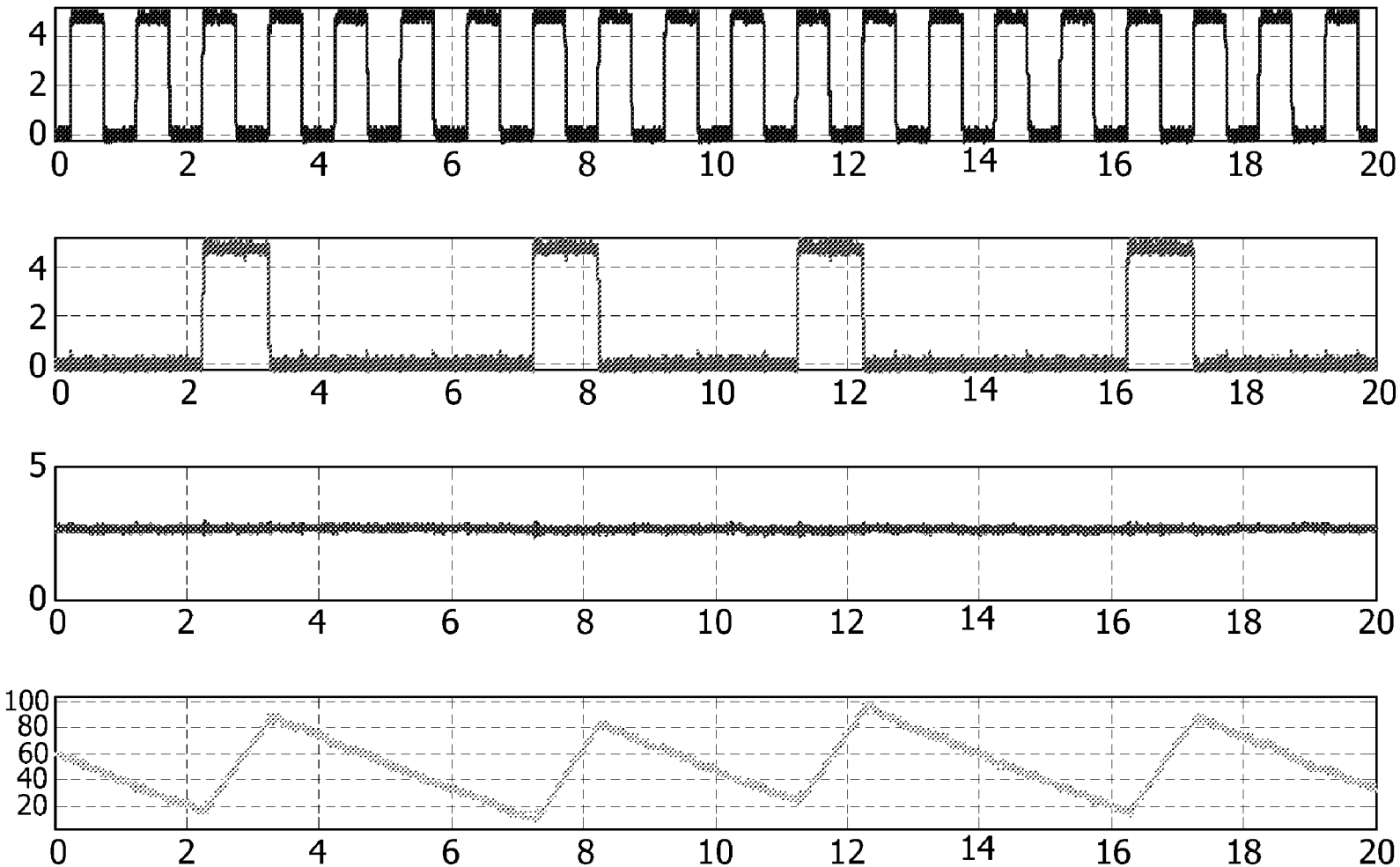
FIG. 11 shows first measurement results of the invention.

In the FIG. 11, first measurement results of the invention are shown (from the upper to the lower graph: clock signal, gate signal, output voltage, and current through inductor), whereby Uin=15V, f-clock=1 MHZ, R-load=51 Ohm, Uout=2.623V, Iout=52.08 mA.

Figure 12:
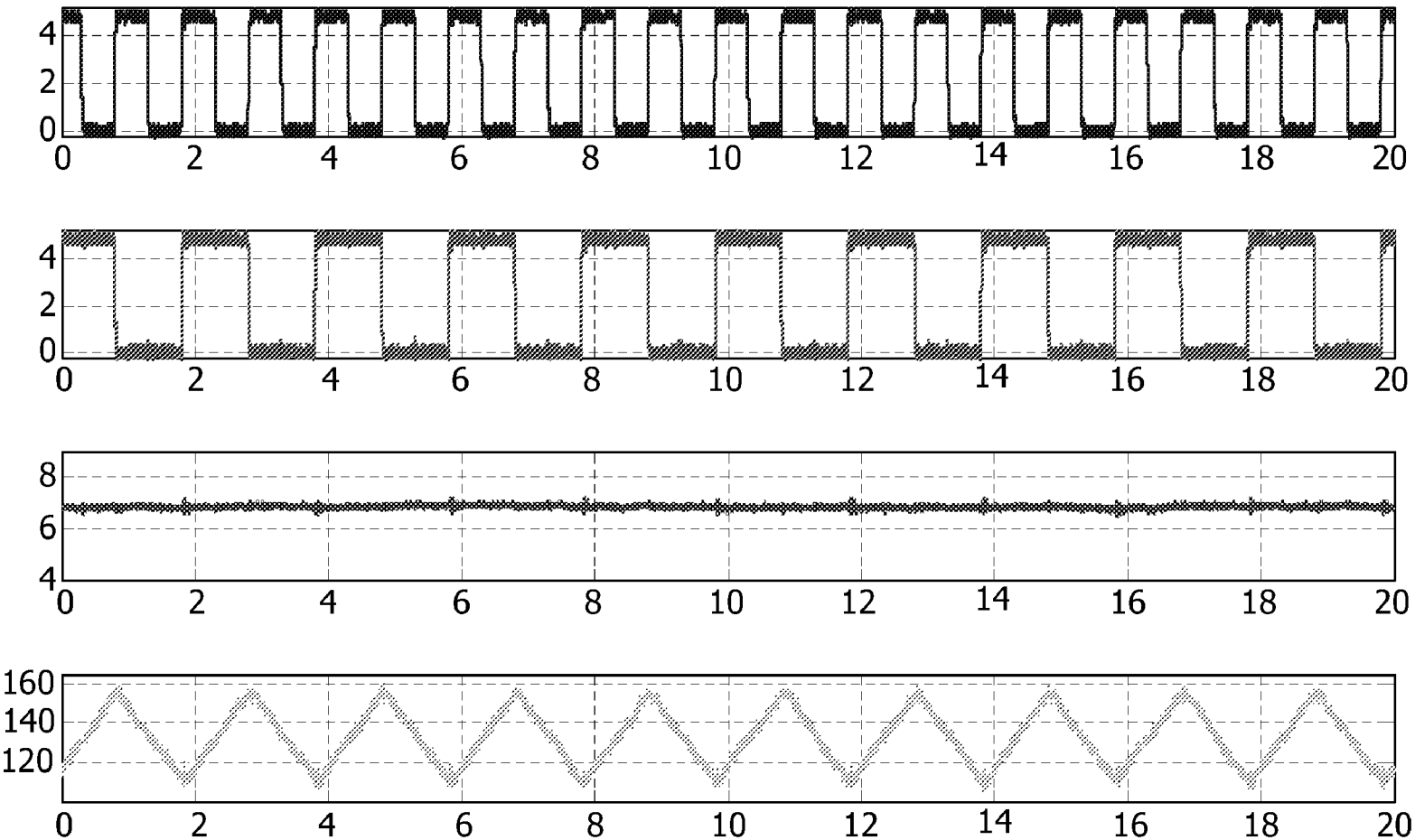
FIG. 12 shows second measurement results of the invention

In the FIG. 12, second measurement results of the invention are shown (from the upper to the lower graph: clock signal, gate signal, output voltage, and current through inductor), whereby Uin=15V, f-clock=1 MHZ, R-load=51 Ohm, Uout=6.844V, Iout=134.41 mA.

The digital hysteretic control offers the following advantages: It is easy to implement. It eliminates a need for expensive converter control ICs. For example, the control can be done by an already available controller, whereby only an additional comparator may be required. It reduces system costs. It is robust and stable. It offers a high dynamic response. The switching frequency is not constant, but its maximum value is limited. In most points of operation, subharmonic converter input currents are generated by the controller. If these harmonics become too low, flicker effects can occur. Nevertheless, if designed correctly, any flicker cannot be observed by the human eye. It is suitable for buck converters, but can also be applied to other topologies.

Summarizing, devices 10 for driving loads 20 such as organic/inorganic light emitting diodes are provided with drivers 11 for driving the loads 20, with converters 12 for converting first parameter signals defining parameters of the loads 20 into second parameter signals each being defined by one bit per time interval, and with digital controllers 13 for controlling the drivers 11 in response to the second parameter signals. The converter 12 may comprise a comparator circuit 40 and a timer circuit 41 for comparing the first parameter signal with a reference signal and for generating the second parameter signal having a respective first or second value of two possible values in case of a respective first or second comparison result. The parameter may be a current flowing through or light emitted by at least a part of the load 20. The driver 11 may be a buck/boost/buck boost/fly back converter. This all without having excluded alternatives and/or additions.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A method, comprising:

driving a load, converting a first parameter signal defining a parameter of the load into a second parameter signal, wherein the second parameter signal is a binary signal having, during each time interval of a group of time intervals, one value out of only two possiblw values, and digitally controlling the driving in response to the second parameter signal, wherein driving the load activating a switch in response to the second parameter signal having a first value of the two possible values and deactivating the switch in response to the second parameter signal having a second value of the two possible values.

2. The method of claim 1, wherein converting the first parameter signal into the second parameter signal comprises:

comparing the first parameter signal to a reference signal to produce a comparison result; and sampling the comparison result with a clock signal to generate the second parameter signal, wherein the one value of the second parameter signal in each time interval corresponds to the comparison result when the clock signal last sampled the comparison result.

3. The method of claim 2, wherein the reference signal is an increasing signal having a decreasing slope.

4. The method of claim 1, wherein the first parameter signal is a digital signal having two or more bits and four or more possible values, and wherein converting the first parameter signal into the second parameter signal comprises converting the digital signal having two or more bits and four or more possible values into the second parameter signal having, during each time interval of a group of time intervals, one value out of only two possible values.

5. The method of claim 1, wherein the load comprises one or more inorganic and/or organic light emitting diodes, and wherein the parameter is a current flowing through at least a part of the load and/or light emitted by at least a part of the load.

6. A device for driving a load, comprising a driver configured to drive the load, a converter configured to convert a first parameter signal defining a parameter of the load into a second parameter signal, wherein the second parameter signal is a binary signal having, during each time interval of a group of time intervals, one value out of only two possible values, and a digital controller configured to control the driver in response to the second parameter signal, wherein the converter comprises:

a comparator configured to receive the first parameter signal and to receive a reference signal, to compare the first parameter signal to the reference signal, and in response to the comparison to output a comparison result; and a timing circuit configured to receive a clock signal and the comparison result and to sample the comparison result in each clock period of the clock signal to generate the second parameter signal.

7. The device of claim 6, wherein the second parameter signal has a frequency equal to or less than a predefined maximum frequency.

8. The device of claim 6, wherein the load comprises one or more inorganic and/or organic light emitting diodes, and wherein the parameter is a current flowing through at least a part of the load and/or light emitted by at least a part of the load.

9. The device of claim 6, wherein the digital controller is configured to further control the driver in response to one or more user signals and/or one or more further parameter signals defining one or more further parameters of the load.

10. The device of claim 9, wherein the digital controller is one micro processor and/or one digital signal processor and/or one integrated circuit and/or one field programmable gate array and/or one complex programmable logic device and/or one personal computer and/or one programmable logic array, at least a part of the converter being an external circuit coupled to the digital controller or being an internal circuit forming part of the digital controller.

11. The device of claim 6, wherein the driver comprises a switch that is activated in response to the second parameter signal having a first value of the two possible values and that is deactivated in response to the second parameter signal having a second value of the two possible values.

12. The device of claim 11, wherein the driver is a buck converter or a boost converter or a buck boost converter or a fly back converter.

13. The device of claim 6, wherein the reference signal is an increasing signal having a decreasing slope.

14. A device for driving a load, comprising a driver configured to drive the load, a converter configured to convert a first parameter signal defining a parameter of the load into a second parameter signal, wherein the second parameter signal is a binary signal having, during each time interval of a group of time intervals, one value out of only two possible values, and a digital controller configured to control the driver in response to the second parameter signal, wherein the first parameter signal is a digital signal having two or more bits and four or more possible values, and wherein the converter is configured to convert the first parameter signal into the second parameter signal by converting the digital signal having two or more bits and four or more possible values into the second parameter signal having, during each time interval of a group of time intervals, one value out of only two possible values.

* * * * *